United States Patent [19]

Lorscheidt

[11] Patent Number: 4,781,483

[45] Date of Patent: Nov. 1, 1988

[54] DEVICE FOR EXPOSING A MASS STORED IN A CONTAINER

[76] Inventor: Willy Lorscheidt, Helenenstrasse 12, D-5024 Pulheim, Fed. Rep. of Germany

[21] Appl. No.: 934,117

[22] Filed: Nov. 24, 1986

[30] Foreign Application Priority Data

Oct. 3, 1986 [DE] Fed. Rep. of Germany ..... 3633754

[51] Int. Cl.[4] ..... B43K 21/02; B65D 41/18

[52] U.S. Cl. ..... 401/55; 401/98; 401/102; 401/60; 215/341; 277/212 F

[58] Field of Search ..... 401/82, 187, 55, 98, 401/59, 60, 61, 108, 176, 177, 178, 102; 277/29, 212 F; 215/341, 343; 222/335, 205, 388, 389

[56] References Cited

U.S. PATENT DOCUMENTS

| | | | |
|---|---|---|---|
| 1,685,413 | 9/1928 | Ashley | 401/177 |
| 2,027,656 | 1/1936 | Tassie | 401/187 |
| 2,573,452 | 10/1951 | Klippert | 401/55 |
| 2,716,504 | 8/1955 | Martin | 215/341 X |
| 3,027,874 | 4/1962 | Bross | 401/176 |
| 3,160,331 | 12/1964 | Trumbull et al. | 222/335 X |
| 3,881,637 | 5/1975 | Browne | 222/335 X |
| 4,139,311 | 2/1979 | Lorscheidt | 401/55 |
| 4,176,757 | 12/1979 | Podesta | 215/341 |
| 4,548,524 | 10/1985 | Seager | 222/205 X |

FOREIGN PATENT DOCUMENTS

| | | | |
|---|---|---|---|
| 568270 | 10/1958 | Belgium | 215/341 |
| 533253 | 2/1922 | France | 401/82 |
| 1213812 | 11/1959 | France | 215/341 |
| 292032 | 10/1953 | Switzerland | 215/341 |
| 0607702 | 10/1978 | Switzerland | 215/341 |
| 900 | of 1890 | United Kingdom | 215/341 |
| 1205887 | 9/1970 | United Kingdom | 215/341 |

*Primary Examiner*—Ronald L. Frinks
*Assistant Examiner*—David J. Bender
*Attorney, Agent, or Firm*—Scully, Scott, Murphy & Presser

[57] ABSTRACT

The invention relates to a device (1) for exposing a mass (3) stored in a container (2). Disposed in container (2) is a conventional follower piston (5), the dispensing opening (4) of container (2) being closed by a removable closure cap (11). For generating a vacuum between mass (3) and closure cap (11) there is provided a circumferential gasket (15) disposed between an outer wall portion (9) of container (2) and closure cap (11). For avoiding early wear of this circumferential gasket (15) and the resultant loss of its sealing properties, the invention provides that on removal of the closure cap (11) the circumferential gasket (15) is positively forced into sealing engagement with the outer wall portion (9) of the container (2) by a force generated by the removal of the closure cap and acting in the direction towards said outer wall portion.

11 Claims, 1 Drawing Sheet

DEVICE FOR EXPOSING A MASS STORED IN A CONTAINER

DESCRIPTION

The invention relates to a device for exposing a mass stored in a container, and more particularly to a device for exposing a mass such as a deodorant stick by creating a vacuum effect to advance the mass out of the container.

A device of this generic type is known for instance from U.S. Pat. No. 4,139,311, this publication relating to a tubular container for slidably containing a filler material in the shape of a stick, for instance a deodorant stick or the like. The known device comprises a container in the form of a sleeve housing a slidably guided follower piston the outwards facing underside of which is acted on by the outer atmosphere. The mass to be dispensed is stored in the sleeve, the dispensing opening of the sleeve being provided with a closure cap threaded onto the sleeve. For facilitating the dispensing of the mass stored in the sleeve, for instance a deodorant stick, the device is provided with a circumferential sealing gasket adapted on removal of the closure cap to produce a vacuum for automatically advancing the mass to its use position on removal of the closure cap. The circumferential sealing gasket of the known device is formed as an annular gasket having an annular gasket body seated in an annular groove adjacent the upper end of the neck of the sleeve and having a resilient sealing lip of substantially sickle-shaped cross-section formed integrally therewith. In the sealing state the outer convex surface of the sealing lip is in engagement with the clindrical inner wall surface of the closure cap. Inserted at the bottom of the closure cap is a further annular gasket for sealingly engaging the end face of the sleeve at the dispensing opening thereof in the closed state.

Removal of the closure cap from the sleeve results in the generation of a vacuum within the closure cap between its bottom and the mass stored in the container, because this space is sealed on the one hand by said circumferential gasket and on the other hand by the stored mass and the follower piston, and remains in this sealed state until the closure cap has been completely removed from the sleeve. The thus generated vacuum is effective to force the resilient sealing lip into engagement with the interior wall surface of the closure cap to thereby ensure a reliable sealing action, so that the mass stored in the container may be automatically advanced to its use position as the closure cap is being removed.

For closing the device after use, the closure cap is seated on the previously advanced mass and pushed down onto the sleeve, whereby the mass and the follower piston are pushed back within the container. As a result, the air contained in the space between the bottom of the closure cap and the mass is compressed, the compressed air being effective to lift the sealing lip of the circumferential gasket off the interior wall surface of the cap, permitting the compressed air to escape.

Although this known device is in fact capable of efficient operation, it suffers from certain shortcomings. For achieving the desired effect on the one hand, and for reasons arrising from the construction of the device on the other, the sealing portions of the circumferential gasket are thus always in their sealing position, with the result that the sealing portions are relatively soon affected by material fatigue, so that they are then no longer capable of satisfactorily carrying out their sealing function. The materials of the sealing portions are moreover subjected to ageing, whereby the above noted deficiency is intensifed. It has been found, moreover, that for achieving the desired effects the known device has to be manufactured with relatively close tolerances, and above all the sealing surfaces have to be very smooth in order to avoid damage to the sealing portions of the circumferential gasket.

It is therefore an object of the present invention to provide a device for exposing a mass stored in a container capable in a most simple manner and over an extended period of use of ensuring the generation of a vacuum for automatically advancing and exposing the stored mass.

The object is attained according to the invention by the providing a sealing gasket on the closure cap which engages the outer wall of the container only upon removal of the closure cap, and which produces a force to create a vacuum effect to advance the mass out of the container in the direction of the closure cap as it is removed.

The invention thus achieves a considerable relief of the circumferential gasket by the provision that the sealing effect is brought to bear only when needed, that is, when the closure cap is removed. In other words, the circumferential gasket of the device according to the invention is in a relxed state as long as its sealing effect is not required, i.e. during replacement of the closure cap and in its closed position, the sealing engagment of the circumferential gasket being positively achieved by the force acting thereon as the closure cap is removed.

This results in the advantage that the circumferential gasket is not endangered by material fatigue, so that the generation of the required vacuum on removal of the closure cap is ensured over an extended period of use. In this context it is to be noted that specific properties of the material of the circumferential gasket in the device according to the invention are of secondary importance, as the sealing engagement is positively established on removal of the closure cap, as explained above.

The subclaims relate to advantageous aspects of embodiments of the invention.

According to a first advantageous aspect, the invention provides that during application of the closure cap and in the closure position thereof the circumferential gasket is in a rest position and cooperates with the outer wall of the container to define a relief passage therebetween. This results in the advantage that the air contained in the open spaces can be readily expelled as the closure cap is replaced on the container.

For generating the sealing force acting on the circumferential seal during removal of the closure cap, a pressure member may be mounted at a suitable location within the closure cap so as to engage the outer surface of a sealing lip of the circumferential gasket on removal of the closure cap.

The pressure member may be formed with a pressure surface at an inclined angle with respect to the outer container wall. This results in the advantage that the pressure member is brought into engagement with the sealing lip smoothly and uniformly to thereby avoid damage to the sealing lip. There is the further resultant advantage that the removal of the closure cap may take place smoothly and uniformly, that is, in a continuous movement.

This effect may be enhanced by the provision that the outer surface of the sealing lip is likewise inclined with respsect to the outer container wall, different angles of inclination of the pressure surface and the outer surface of the sealing lip resulting in the further advantage that the outer surface of the sealing lip is in linear contact with the pressure surface of the pressure member, whereby separation of these two components on replacement of the closure cap is facilitated or ensured, respectively.

To further ensure this separation the pressure member is spaced from the sealing lip by a suitable distance in the closed position of the closure cap.

In a further advantageous embodiment the closure cap is formed with inner threads cooperating with outer threads formed on the outer wall of the container. In this case the pressure member is disposed between the sealing lip and the adjacent end of the interior threads to thereby ensure the camming engagement of the pressure member with the outer surface of the sealing lip as the closure cap is being unscrewed.

In a particularly advantageous embodiment with regard to manufacturing techinques, the interior threads are formed as a threaded sleeve adapted to be secured to the closure cap and integrally connected to the pressure member. This results in further particular advantages during assembly, as both the inner threads and the pressure member can be secured within the closure cap in a single operation.

It is further possible to provide the closure member with a cup-shaped insert member which may be connected to the circumferential gasket. This results likewise in advantages with regard to manufacturing techniques and assembly, as it permits the number of components of the device according to the invention to be reduced.

Further particular advantages may be obtained by mounting the cup-shaped insert member within the closure cap with axial and radial play. Particularly when the stored mass is a solidified mass, for instance a deodorant stick, this embodiment permits a screw-threaded closure cap to be replaced on the container without the cup-shaped insert member following the rotation of the closure cap. The insert member is then rather seated on the deodorant stick to prevent the latter from being heated by the otherwise generated friction between the insert member and itself. Such heating of the mass would otherwise result in the mass being partially liquefied and the device being smeared therewith, impairing its appearance.

Further details, characteristics and advantages of the invention will become evident from the following description of a preferred embodiment with reference to the accompanying drawings, wherein:

Figure 1:
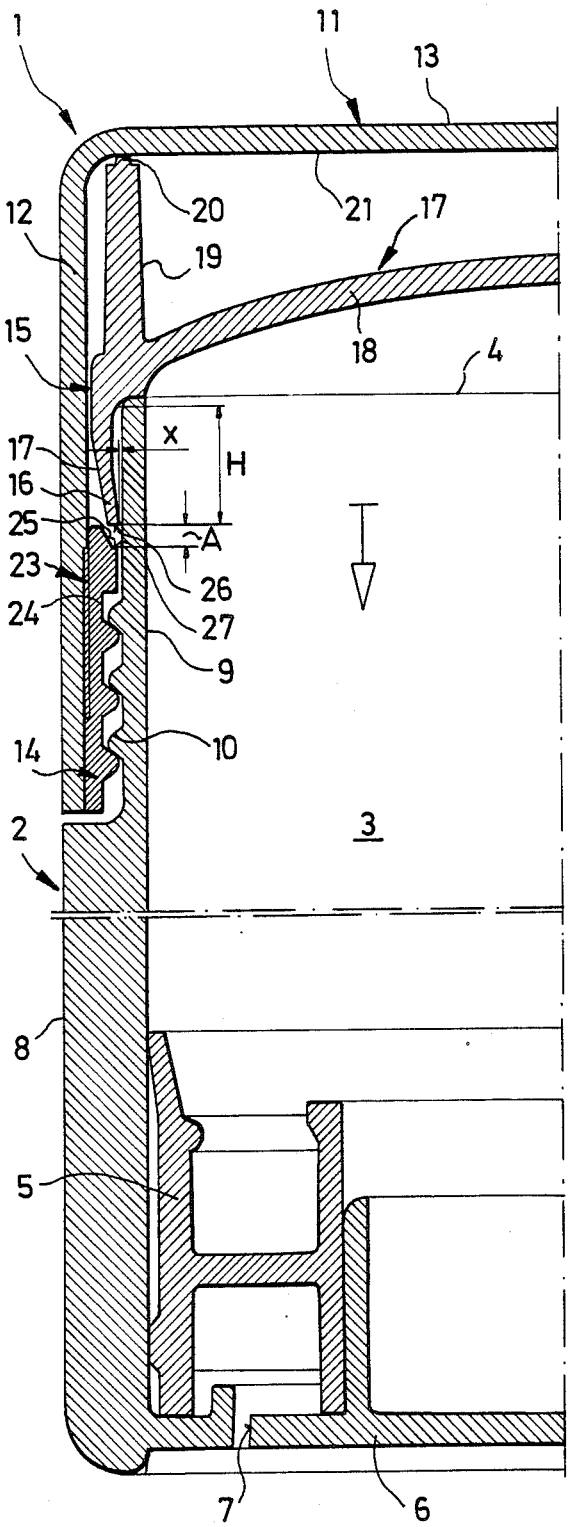
FIG. 1 shows a longitudinal section through one half of a device according to the invention.

Depicted in FIG. 1 is one half of a device 1 according to the invention, specifically the left half of a device of symmetric construction. Device 1 comprises a container 2 for the storage of a mass 3 therein. The mass 3 may be of a paste-like nature or a solidified mass as employed for instance in a deodorant stick. Container 2 is of cylindrical shape and provided with a dispensing opening 4. Disposed in the end of container 2 opposite opening 4 is a follower piston 5 which may be of conventional construction. The end of container 2 below follower piston 5 is closed by an end wall 6 formed with a passage 7 for permitting the outer atmosphere to act on follower piston 5.

Container 2 further has an outer wall 8 having an outer wall portion 9 of reduced wall thickness adjacent opening 4. In the embodiment shown by way of example, outer wall portion 9 is formed with outer threads 10.

In the state shown in FIG. 1 device 1 is closed by a closure cap 11. Closure cap 11 is shaped to conform to the contours of container 2, with a cylindrical outer wall 12 closed at one end by an end wall 13. Disposed within closure cap 11 is a sleeve 14 formed with inner threads for cooperation with outer thread 10. Threaded sleeve 14 is a separate member connected to closure cap 11 adjacent the opening thereof.

The device 1 according to the invention further comprises a circumferential gasket 15 having a sealing lip 16, the latter having an outer surface 17 facing the interior wall surface of closure cap 11. Outer surface 17 is inclined at an angle with respect to outer container wall 8 or the longitudinal center axis of container 2 in the manner shown in FIG. 1.

In the embodiment shown in FIG. 1, circumferential gasket 15 is integrally connected to a cup-shaped insert member 17. Insert member 17 has a dome-shaped central portion 18 with an annular wall portion 19 projecting therefrom towards end wall 13 of closure cap 11. As particularly shown in FIG. 2, cup-shaped insert member 17 is disposed within closure cap 11 with axial and radial play. In the closed state of device 1 shown in FIG. 1 insert member 17 is seated on the inner surface of end wall 13 of closure cap 11 with a seating surface 20 of reduced area, permitting closure cap 11 to be readily rotated relative to insert member 17 when it is being placed on container 2. As a result, insert member 17 is not rotated relative to mass 3 in container 2, this being of particular advantage in the case of a solidified mass, for instance a deodorant stick or the like, as it enables undesirable smearing of the device due to the friction effect to be avoided.

Figure 2:
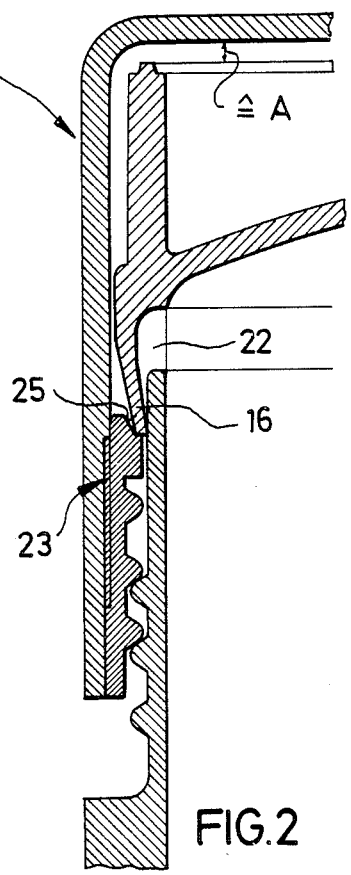
FIG. 2 shows an illustration corresponding to FIG. 1 of part of the device during removal of the closure cap.

As further evident from FIGS. 1 and 2, a gap x may be provided between the sealing surface of sealing lip 16 and the surface of outer wall 9 to be engaged thereby, so that an annular gap is formed in the case of a circular cylindrical container 2 as shown. This annular gap facilitates the escape of air entrapped between insert member 17 and container 2. The space existing between insert member 17 and container 2 on replacement of closure cap 11 is designated by the numeral 22 in FIG. 2.

In this context it is to be noted, however, that it is not essential that such gap x be provided. It would for instance also be feasible that sealing lip 16 is in loose contact with the surface of outer wall 9, in which case the escape of entrapped air would be ensured by sealing lip 16 being lifted off the surface of outer wall 9 by the pressure of the air entrapped and compressed in space 22 on replacement of closure cap 11 so as to effectively act as a valve. In this respect it has to be emphasized that the loose engagement of sealing lip 16 with the surface of outer wall 9 will not result in undesirable wear.

Indicated at H in FIG. 1 is the stroke by which the mass stored in container 2 may be advanced, the mass being assumed to be a solidified substance.

The shown embodiment of device 1 further includes a pressure member 23. In the example shown, pressure member 23 has a cylindrical body 24 having its end facing towards sealing lip 16 formed with a pressure surface 25 which is inclined with respect to outer container wall 9 and faces towards outer surface 17 of sealing lip 16, pressure surface 25 and outer surface 17 being inclined at different angles. The lower end 26 of sealing lip 16 is spaced from the intersection 27 between pressure surface 25 and body 24 by a distance A within which sealing lip 16 projects towards pressure member 23 in the closed state of closure cap 11. As further shown in FIGS. 1 and 2, pressure member 23 is integrally connected to threaded sleeve 14 at a location between the latter and sealing lip 16.

The device according to the invention as shown in FIGS. 1 and 2 operates as follows:

Whenever mass 3 is to be dispensed from container 2, it being assumed that mass 3 is a solidified substance such as a deodorant stick, closure cap 11 is removed from container 2 as by unscrewing in the example shown. As closure cap 11 is being thus unscrewed, pressure surface 25 of pressure member 23 is brought into engagement with outer surface 17 of sealing lip 16 as shown in FIG. 2. This results in the generation of a force biasing sealing lip 16 of circumferential gasket 15 into engagement with outer wall portion 9. Sealing lip 16 is thus sealingly engaged with outer wall 9 of container 2. Removal of closure cap 11 thus enables a vacuum to be generated between closure cap 11, or insert member 17, respectively, and mass 3, due to the fact that the opposite end of container 2 is sealingly closed by follower piston 5. The thus generated vacuum is effective to pull mass 3 out of container 2 by a stroke H determined by the overall construction of the device. After closure cap 11 has thus been completely removed, mass 3 is exposed and freely accessible for the intended use.

For reclosing container 2, closure cap 11, or rather insert member 17 loosely contained therein, is seated on mass 3 projecting from container 2, whereby sealing lip 16 may be released from the possibly still existing engagement with pressure member 23. Release of this engagement is facilitated by the different angles of inclination of outer surface 17 and prssure surface 25, and additionally by the fact that on replacement of closure cap 11 sealing lip 16 nearly always comes into light contact with the end face of outer wall 9, which is sufficient to release the possibly still existing engagement.

As closure cap 11 is being replaced, air contained in annular space 22 is permitted to escape either through annular gap x or, if sealing lip 16 is in tension-free contact with outer wall portion 9, by deformation of sealing lip 16 due to compression of the entrapped air. In the completely closed state of closure cap 11, the various parts assume the relative positions as shown in FIG. 1, circumferential gasket 15 and its sealing lip 16 being completely relaxed in the absence of any sealing force acting thereon. A sealing effect is not required in this state and has only to be reestablished when container 2 is again to be opened for exposing mass 3. This results in the particular advantage that, as long as the sealing effect is not requried, circumferential gasket 15 is completely relaxed, so that there arise no problems from material fatigue or early wear.

Although with reference to FIGS. 1 and 2 the device 1 according to the invention has been described by way of example for use with a solidified mass, it is likewise possible to use device 1 in combination with a paste-like product. In this case insert member 17 may be modified by the provision of a domed center portion 18 facing towards the product and formed with a recess effective to advance the paste-like product to its exposed use position on removal of closure cap 11.

It is similarly possible to provide different means for generating the force required for bringing circumferential gasket 15 into its sealing engagement. It is thus for instance possible to provide a pressure member in the form of a pressure ring having a selectively expandable and reducible diameter on the outside of closure cap 11. This pressure ring may then likewise be actuated only when a sealing action is required, to thereby obtain the same advantages.

In a particularly simple embodiment, the outer surface of closure cap 11 may be formed with a circumferential groove projecting inwards at the level of sealing lip 16. Resilient deformation of this groove by external pressure will then apply a force to the sealing lip to obtain the required sealing action.

Closure cap 11 may also be provided with detent means other than threads. The closure cap may thus be designed for being simply slipped onto container 2 and for being retained in its closed state by a snap engagement coupling. In another modification the interior threads may be formed directly in closure cap 11.

I claim:

1. A device for exposing a mass stored in a container, comprising a follower piston slidably guided in said container and subjected to the action of the outer atmosphere, a closure cap removably disposed on the dispensing opening of said container, and a circumferential sealing gasket provided on said closure cap between the circumferential wall of said closure cap and the outer wall of said container and spaced from said outer container wall, for producing a vacuum acting to advance said means on removal of said closure cap, wherein, during removal movement of said closure cap, said circumferential sealing gasket is forced into sealing engagement with said outer wall of said container by a force produced by such removal and acting in the direction towards said outer wall.

2. A device according to claim 1, characterized in that during application of said closure cap and in the closure position thereof said circumferential sealing gasket is in a rest position and is positioned a distance from said outer wall of said container to define a relief opening therebetween.

3. A device according to claims 1 or 2, characterized in that said circumferential sealing gasket is formed with a sealing lip the outer surface of which is engaged by a pressure member provided on said closure cap is said closure cap is removed to force the inner surface of said sealing lip into sealing engagement with said outer wall of said container.

4. A device according to claim 3, characterized in that said pressure member is formed with a pressure surface facing said outer surface of said sealing lip and inclined with respect to said outer container wall.

5. A device according to claim 4, characterized in that said outer surface of said sealing lip is inclined with respect to the outer container wall.

6. A device according to claim 5, characterized in that said pressure surface and said outer surface are inclined at different angles.

7. A device according to claim 6, characterized in that in the closure position of said closure cap said pressure member is spaced from sealing lip.

8. A device according to claim 7, characterized in that said closure cap is formed with interior threads cooperating with outer threads formed on said outer container wall, said pressure member being disposed between said sealing lip and the adjacent end of said inner threads.

9. A device according to claim 8, characterized in that said inner threads are formed as a threaded sleeve adapted to be secured to said closure cap and integrally connected to said pressure member.

10. A device according to claim 9, characterized in that said closure cap has disposed therein a cup-shaped insert member connected to said circumferential sealing gasket.

11. A device according to claim 10, characterized in that said insert member is disposed in said closure cap with an axial play corresponding to said spacing and a small radial play.

* * * * *